US012637927B1

(12) United States Patent
Hoelscher et al.

(10) Patent No.: US 12,637,927 B1
(45) Date of Patent: May 26, 2026

(54) FLUID TRAP AND BAFFLE SYSTEM

(71) Applicant: Halliburton Energy Services, Inc., Houston, TX (US)

(72) Inventors: Christopher C. Hoelscher, Arlington, TX (US); Kevin Cook, Arlington, TX (US); Joshua Lavery, Perth (AU)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 19/037,006

(22) Filed: Jan. 24, 2025

(51) Int. Cl.
*E21B 43/1185* (2006.01)
*E21B 43/08* (2006.01)

(52) U.S. Cl.
CPC ..... *E21B 43/1185* (2013.01); *E21B 43/08* (2013.01)

(58) Field of Classification Search
CPC ..... E21B 43/1185; E21B 43/08
See application file for complete search history.

(56) References Cited

U.S. PATENT DOCUMENTS 3,584,701 A * 6/1971 Freeman ..... F01N 3/2807 181/280
6,386,296 B1 5/2002 Kothari et al.
8,967,256 B2 * 3/2015 Walker ..... E21B 49/081 166/55
10,758,855 B2 9/2020 Horner et al.
2008/0087419 A1 4/2008 Fair
2017/0350214 A1 * 12/2017 Norman ..... E21B 43/26
2022/0034636 A1 * 2/2022 Cohen ..... F42B 12/10
2022/0397010 A1 * 12/2022 Zakharia ..... E21B 23/065
2025/0043667 A1 * 2/2025 MacGillivray ..... E21B 43/117
2025/0101838 A1 * 3/2025 Cook ..... E21B 43/1185

* cited by examiner

*Primary Examiner* — Steven A MacDonald
(74) *Attorney, Agent, or Firm* — NOVAK DRUCE CARROLL LLP

(57) ABSTRACT

Aspects of the subject technology relate to apparatus and methods for monitoring constituent components of underground fluids. A perforation device of the present disclosure may be physically attached to a casing, the casing may be placed in a wellbore, and an explosion may be initiated that results in establishing fluid communication between subterranean strata of a wellbore and sensors of a sensing apparatus. The perforation device may include a baffle that protects both explosive charges used to generate the explosion and a tube that couples subterranean fluid to the sensors. The baffle may protect the tube from physical damage and from being clogged by debris from the explosion. The baffle may also protect the explosive charges by collecting liquid that otherwise might wet the explosive charges. Data collected by the sensors may be evaluated before, during, and after the performance of a wellbore operation (e.g., a carbon sequestration operation).

20 Claims, 8 Drawing Sheets

FLUID TRAP AND BAFFLE SYSTEM

TECHNICAL FIELD

The present technology pertains to improving the operation of wellbore perforation devices, and more particularly, to devices that once deployed may be used to help identify constituent components of fluids present in underground strata.

BACKGROUND

When managing oil and gas drilling and production environments (e.g., wellbores, etc.), performing operations in the oil and gas drilling and production environments, and/or sequestering materials underground (e.g., carbon sequestration and storage), it is important to sense data and to make determinations based on that sensed data. Wellbore environments are often noisy and sensors used to sense wellbore conditions can be affected by this noise. Noise encountered in the wellbore environment that may affect sensors include mechanical/acoustic noise (e.g., noise from vibration, seismic activity, the movement of fluids, or the movement of equipment), thermal noise (e.g., Johnson noise—electronic noise generated from thermal agitation of electrons or other carriers of charge), electromagnetic noise (e.g., unwanted radio frequency signals, or electromagnetic fields associated with manmade devices or with natural phenomenon) and noise associated with subatomic particles (e.g., radiation).

Other types of sensing apparatus may be deployed at the surface of a wellbore without worrying about the effects of acoustic noise, electromatic noise, and radiation. Here materials extracted from underground repositories may be tested using laboratory equipment. For example, fluids or rock samples extracted from a wellbore may be tested to determine constituent components or properties of those fluids or rock samples.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings.

DETAILED DESCRIPTION

Figure 1:
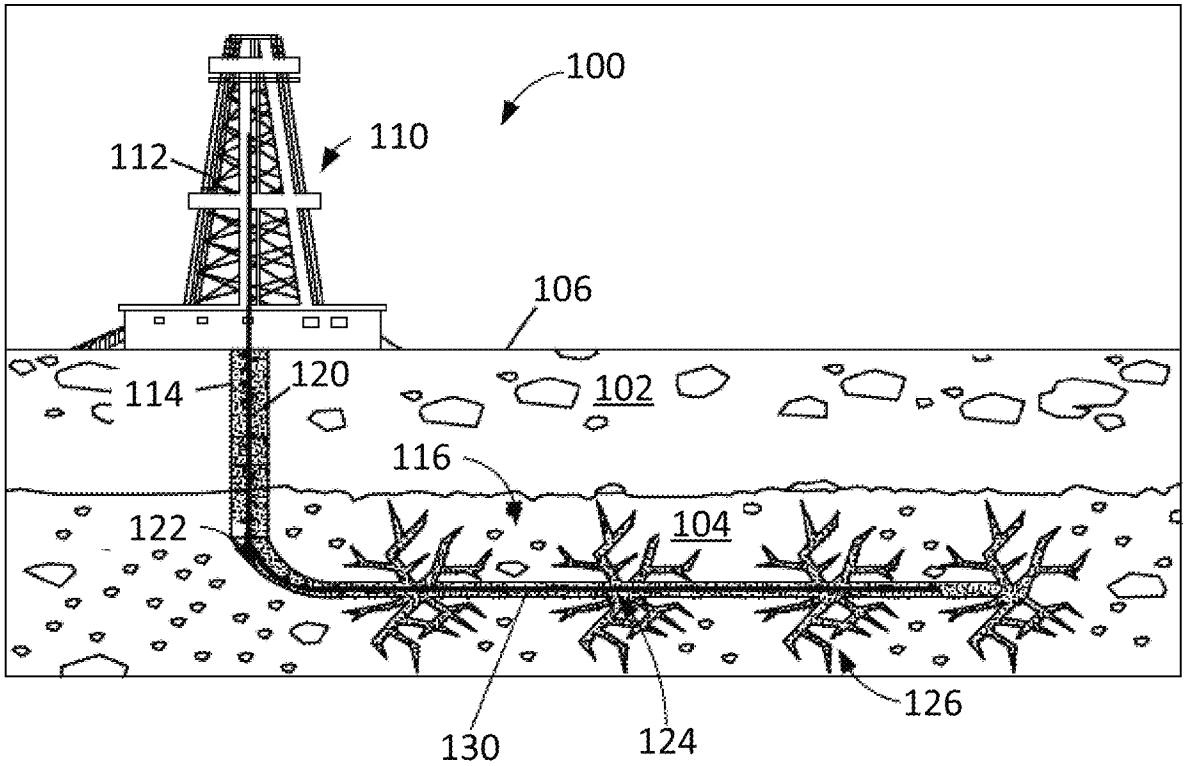
FIG. 1 illustrates a schematic view of an example wellbore operating environment, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The present disclosure relates to devices that make perforations or holes in structures or strata of a wellbore. Such devices include explosive charges that are placed in selected locations of a wellbore. Once positioned in a wellbore, the explosive charges may be detonated with the intent of blasting holes in either or both manmade or natural structures of the wellbore. In some instances, holes may be blasted in a wellbore casing. In other instances, such devices may also be used to create holes or cracks in natural structures (formations, rock, and/or subterranean strata) that surround the wellbore. Once such perforations are made, the wellbore may be used for various purposes that include yet are not limited to hydrocarbon extraction, hydraulic fracturing, or carbon sequestration. Two major concerns in the design and use of explosives are safety and reliability. In many instances, explosives and systems used to deploy explosives are susceptible to failing when fluid (e.g., water) wets or dampens the explosives. Apparatus of the present disclosure may isolate a chamber where explosives are present from water that may be introduced into the apparatus. Alternatively, or additionally, apparatuses of the present disclosure may protect certain parts of the apparatus from blast shock waves or may help prevent particles generated by an explosion from interfering with operation of a sensing system.

Aspects of the subject technology relate to apparatus and methods for monitoring constituent components of underground fluids. A perforation device of the present disclosure may be physically attached to a wellbore structure, for example, a wellbore casing. As such, the casing may be placed in a wellbore, and an explosion may be initiated that results in establishing fluid communication between subterranean strata of a wellbore and sensors of a sensing apparatus. The perforation device may include a baffle that protects both explosive charges used to generate the explosion and a tube that couples subterranean fluid to the sensors. The baffle may protect the tube from physical damage and from being clogged by debris from the explosion. The baffle may also protect the explosive charges by collecting liquid or moisture that otherwise might ingress the perforating system including the explosive charges and/or the volume surrounding the charges. Data collected by the sensors may be evaluated before, during, and after the performance of a wellbore operation (e.g., a carbon sequestration operation).

Liquid entering a perforating apparatus may create various problems that may reduce the effectiveness of the apparatus. For example, liquid entering a gun chamber of a perforation device may suppress the explosion of an energetic material (e.g., gunpowder), cause miss-fire, or cause a low-order detonation. Additionally, the introduction of a liquid into a perforation apparatus increases mass inside of the apparatus and this may cause failures of the apparatus by reducing or changing the free air volume in the system. The free air volume in the system provides air and oxygen to the chemical reaction that creates the explosion. The free air volume also may provide means for the expanding gases of the explosive reaction to fill and dissipate prior to the perforating a chamber that houses explosive charges. Thus, this affects the stress load applied to the components from the generated pressure and shock from the detonation.

FIG. 1 illustrates a schematic view of an example wellbore operating environment. As depicted in FIG. 1, example operating environment 100 includes a wellbore 114 that penetrates a formation 102. Such perforations may be performed for the purpose of recovering hydrocarbons from formation 104, storing hydrocarbons, or injecting substances (e.g., fracturing fluids, water, or carbon dioxide) into formation 104. In certain instances, the purpose of operating environment 100 may be for carbon capture & storage (CCS), and such operations may use equipment that are not shown in FIG. 1. In other instances, the purpose of operating environment 100 may be associated with capturing geothermal energy, and such operations may use components that are not shown in FIG. 1.

As depicted in FIG. 1, formation 102 &104 are subterranean formations, although it is noted that formations 102 &104 may be subsea formations. In certain locations, there may be a plurality of underground formations 102 & 104. Wellbore 114 may extend substantially vertically away from surface 106 over a vertical wellbore portion or may deviate at any angle from surface 106 over a deviated or horizontal wellbore portion 116. In alternative operating environments, portions or substantially all of wellbore 114 may be vertical, deviated, horizontal, and/or curved. Wellbore 114 may be drilled into the formations 102 and/or 104 using any suitable drilling technique. As shown, a drilling or servicing rig 110 disposed at the surface 106 (which may be the surface of the Earth, a seafloor surface, or a sea surface) comprises a derrick 112 from which a tubular string 120 (e.g., a drill string, a tool string, a segmented tubing string, a jointed tubing string, or any other suitable conveyance, or combinations thereof) is positioned within or partially within the wellbore 114. The tubular string 120 may include two or more concentrically positioned strings of pipe or tubing (e.g., a first work string may be positioned within a second work string). The drilling or servicing rig 110 may include a motor driven winch and other associated equipment for lowering the tubular string 120 into the wellbore 114. Alternatively, a mobile workover rig, a wellbore servicing unit (e.g., coiled tubing units), or the like may be used to lower the work string into the wellbore 114. In such an environment, the tubular string 120 may be utilized in drilling, stimulating, completing, or otherwise servicing the wellbore, or combinations thereof. Servicing rig 110 may also comprise other equipment. In certain types of operations, a fluid 122 is forced down the tubular string 120 and out through perforations 124 to fracture the formations 104 that surround the perforations 124. The fluid may flow into such perforations when cracks 126 are formed and/or expand perforations 124 in formation 104.

While FIG. 1 depicts a stationary servicing rig 110, one of ordinary skill in the art will readily appreciate that mobile workover rigs, wellbore servicing units (such as coiled tubing units), and the like may be employed. In the context of subsea environments and/or subsea formations, one of ordinary skill in the art will appreciate that conventional fixed platforms, vertically moored platforms, spar platforms, semi-submersible platforms, floating production facilities, and sub-sea completion facilities and the like may be employed. It is noted that while the figures or portions thereof may exemplify horizontal or vertical wellbores, the principles of the presently disclosed apparatuses, methods, and systems, may be similarly applicable to horizontal wellbore configurations, conventional vertical wellbore configurations, deviated wellbore configurations, and any combinations thereof. The horizontal, deviated, or vertical nature of any figure is not to be construed as limiting the wellbore to any particular configuration or formation.

Example operating environment 100 includes one or more sensors 130 deployed in wellbore 114. The operating environment 100 can include a completed well and the one or more sensors 130 can be deployed in the wellbore 114 after a well completion phase. Alternatively, the operating environment 100 can be during a well completion and the one or more sensors 130 can be deployed in the wellbore 114 after the well completion phase.

Figure 2:
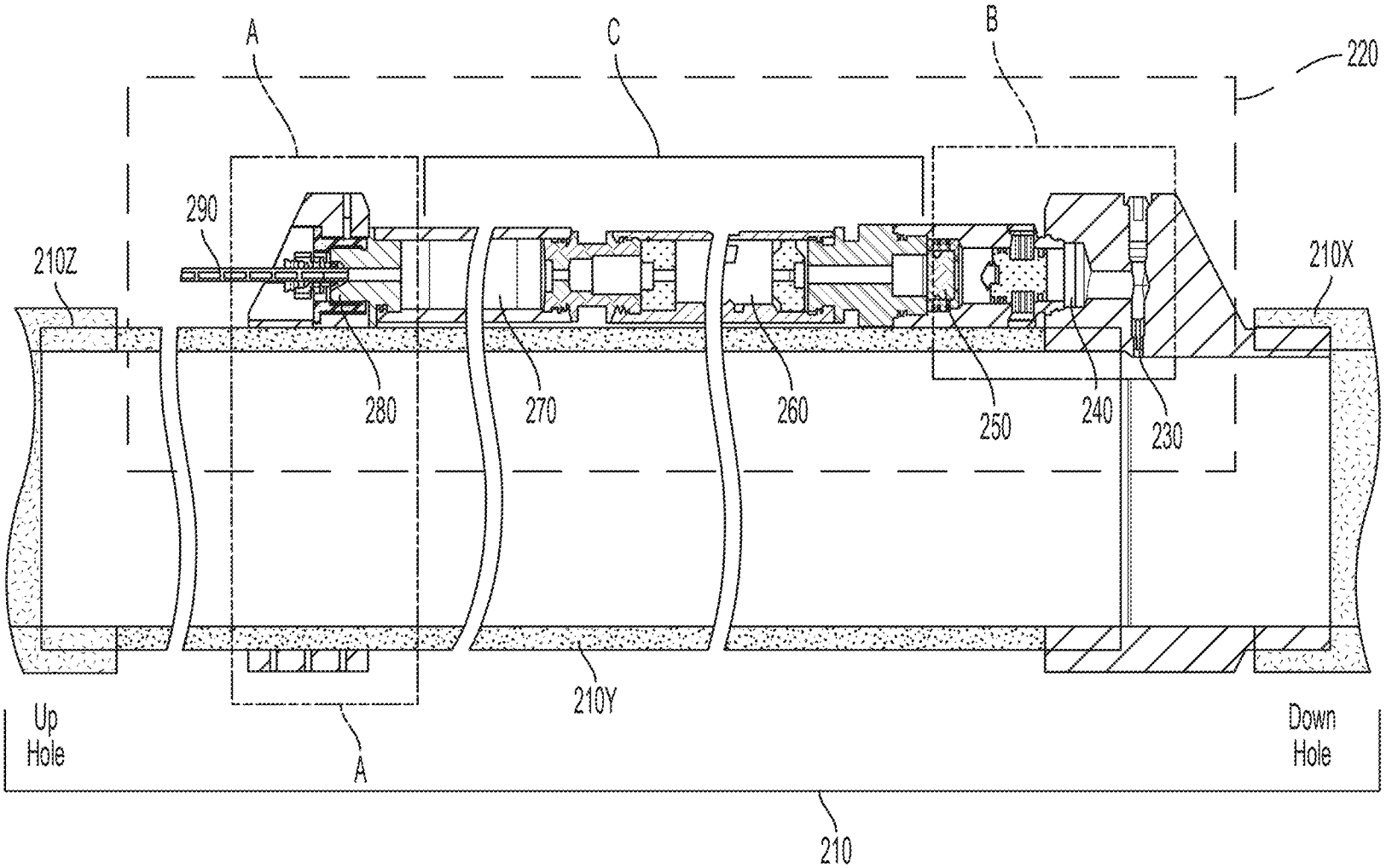
FIG. 2 illustrates a perforation apparatus or string that may be deployed in a wellbore, in accordance with various aspects of the subject technology.

FIG. 2 illustrates a perforation apparatus or string that may be deployed in a wellbore. FIG. 2 illustrates three portions of a wellbore casing 210 (210X, 210Y, and 210Z) where casing portion 210Z is up hole of casing portions 210X and 210Y and where casing portion 210X is located down hole of casing portions 210Y and 210Z. Perforation string 220 is shown as being attached to casing portion 210Y. Perforation string 220 may include input port 230, actuation or firing pin 240, explosive detonator 250, perforating gun chamber 260, debris collection chamber 270, baffle 280, and tube 290. Perforation string 220 may be partitioned into three different sections, section A that houses baffle 280; section B that includes input port 230, firing pin 240, and detonator 250; and second C that includes detonation cord, explosive charges, and debris chamber 270.

When casing 210 is deployed in a wellbore, casing portions 210X, 210Y, and 210Z may be coupled together and then cemented in place within the wellbore. As such, casing 210 may be attached to strata of the wellbore with cement.

A firing assembly of the perforation apparatus may include input port 230, a shearable element (e.g., a metal disk or foil), firing pin 240, and explosive detonator 250.

While not illustrated in FIG. 2, perforating gun chamber 260 may include one or more explosive charges and detonation cord. Input port 230 may initially be blocked with a disk or shearing element that is configured to rupture (e.g., break or burst) when a pressure is applied to an inside portion of the wellbore casing. Any apparatus capable of producing sufficient pressure down a wellbore or in a vicinity close to input port 230 may be used to provide a pressure impulse (a pulse of hydraulic or acoustic pressure) that breaks this shearing element. Examples of such devices include yet are not limited a pump, a pump connected to downhole rigging, a horn, or other device that may be placed in casing 210 or at the head of a wellbore (wellhead). When such a pressure impulse is provided inside of the wellbore casing, the shear disk or element that blocks input port 230 may rupture. Some of the pressure of this pressure impulse may move through port 230 and this may result in firing pin 240 being released. In such an instance, firing pin 240 may be spring loaded and be held in place until the pressure wave releases firing pin 240. In other instances, when firing pin 240 is not spring loaded, it may be held in place by friction forces or shear pins. Various forces may be used to force the firing pin 240 toward detonator 250. As such, firing pin 240 may be forced toward detonator 250 by spring force, by force of the pressure wave, by a combination of both, or by other means. Since port 230 is used to trigger an explosion, it may be referred to as being a "trigger port."

While a pressure wave may be used to initiate an explosion, apparatus and methods of the present disclosure may use other mechanisms to initiate an explosion. In certain instances, an explosion may be initiated by an electronic trigger (wired or wireless). Furthermore, a firing mechanism may be armed and then actuated by electronic means. Such electronic mechanisms may include a wired or wireless electronic trigger or detonator. One such illustration is the use of a addressable digital detonator in which the power signal line (e.g., one or more wires) may be installed along the well casing similar or together with the sampling conduit (tubing). One control signal may be used to arm a detonator, and another control signal may be used to initiate the explosion. In other instances, only a single signal may be used to initiate detonation of a set of explosive charges. Here again, spring loaded firing pins or other mechanisms may be used to the explosion.

In some instances, a telemetry system may be used to send a signal to trigger a detonator or to incorporate a valve or actuator that pierces a disc/foil to open the firing head, or to apply a pressure capable of triggering an explosion. When wireless triggers are used, radio signals may be used to transmit one or more control signals. As such a radio transmitter may be capable of transmitting signals down a wellbore may transmit a signal to a receiver circuit that controls the detonation of a detonator. In some instances, a first signal may be used to arm a detonator, and a second signal may be used to initiate detonation.

Once firing pin 240 impacts detonator 250, detonator 250 may ignite explosive charges (not shown in FIG. 2) located within perforating gun chamber 260. When an explosion occurs in perforating gun chamber 260, holes may be blasted through a wall of the perforating gun chamber 260 and this blast may also create perforations or fractures in strata next to the holes blasted through the wall of the perforating gun chamber. In certain instances, areas where the holes are blasted may be weaker than other portions of the wall. Such weaker areas may be made by a machining process and in other instances holes in the wall may be covered with shearing elements (not shown in FIG. 2) may rupture (e.g. burst or break). These holes may act as vent ports that vent explosive gasses into the wellbore environment. Examples of shearing elements include yet are not limited to pins, metallic disks and metallic foil (e.g., stainless steel disks or foil). When charges are used, their detonation may result in a high velocity jet of particles being propelled into strata that surrounds perforating gun chamber 260. Such an explosion may result in perforations being formed in strata around casing portion 210Y. This explosion may also create holes in cement that attaches the casing to a wall of the wellbore. Forces from the explosion may also send shock waves and debris toward debris chamber 270 and baffle 280.

A shaped charge may be used to explosive energy into a narrow jet. An explosive charge may be designed to include an open space or hollow cavity. This space or hollow cavity may be lined with metal and the charge may have a geometric shape that focuses explosive forces and that may direct where pieces of the metal lining (e.g., shrapnel) are directed when an explosion occurs. In some instances, this space or cavity may be in the shape of a cone or hemisphere. When an explosive charge detonates and when a metallic liner is used, the metallic liner may collapse inward at high velocity. This collapse may form a "high velocity" jet of metal particles. In some instances, these velocities may reach or exceed 10 thousand meters per second (km/s). The jet's kinetic energy may allow the blast and blast debris to penetrate armor or other materials by exerting immense pressure on a small area. Such a jet may essentially "drill" through a target area of a wellbore. This penetration process may be purely kinetic, not reliant on heat, although significant heat may be generated as a byproduct.

After an explosion, a pathway that wellbore fluids traverse may pass through the holes formed during the explosion into perforating gun chamber 260 and into tube 290. Tube 290 may be used to transport the wellbore fluid to sensors used to monitor materials included in the wellbore fluid. As such, tube 290 may provide fluid from the wellbore strata up to the surface where a sensing system may be used to identify constituent components of the wellbore fluid. In some instances, for example in a CSS field, a sensing system may sense the presence and/or density of carbon dioxide included in the wellbore fluid. Sensors coupled to tube 290 may be used to monitor or control flows of carbon dioxide during or after a carbon sequestration process.

Figure 3:
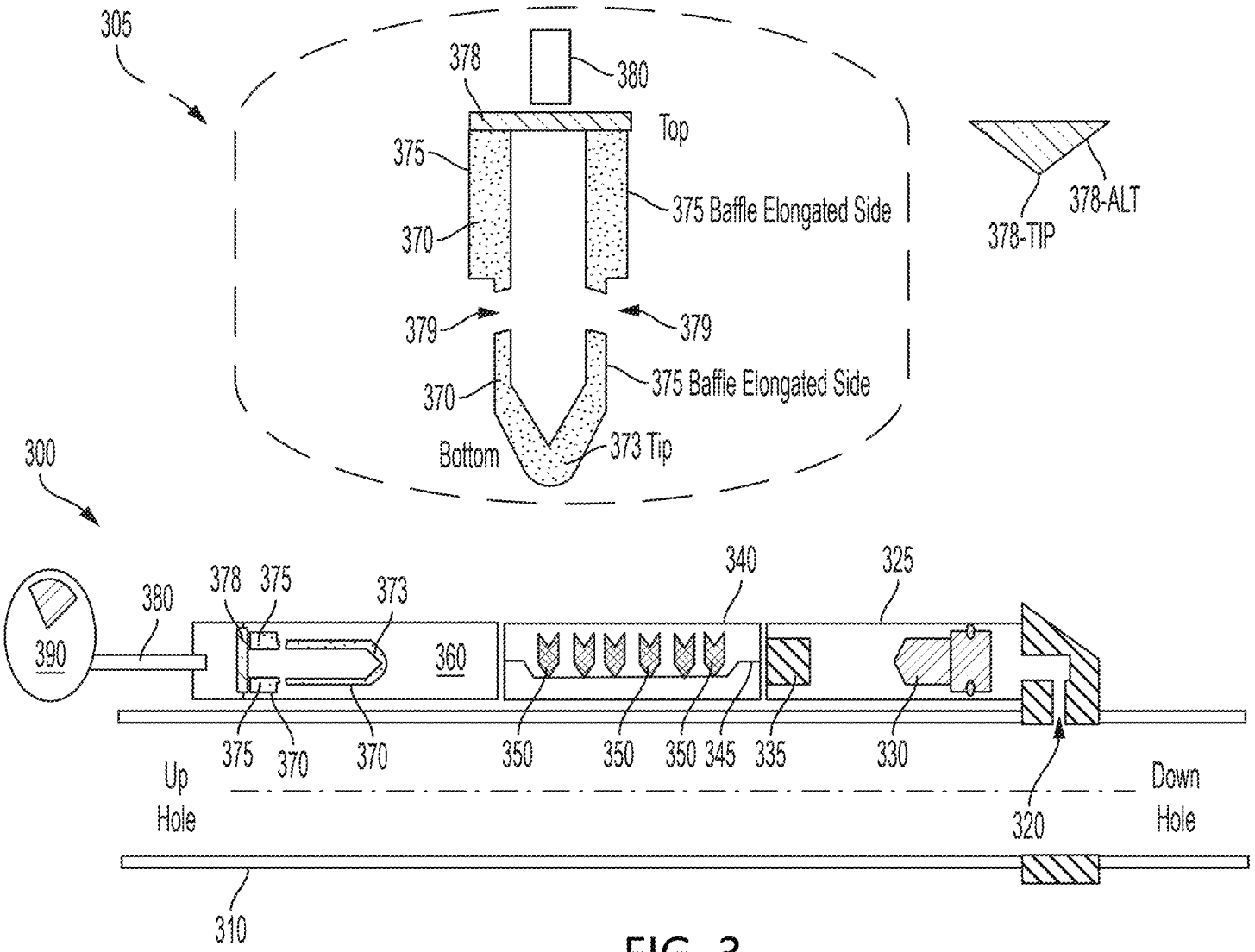
FIG. 3 illustrates a baffle and explosive firing assembly of a perforation apparatus, in accordance with various aspects of the subject technology.

FIG. 3 illustrates a baffle and explosive firing assembly of a perforation apparatus. FIG. 3 includes a cross-section side view of a perforation apparatus 300 and FIG. 3 includes expanded view 305 of baffle 370 that may be built within the perforation apparatus.

Like the perforation string 220 of FIG. 2, the perforation apparatus of FIG. 3 is mounted to a casing (310) and this perforation apparatus includes an access port (320), a firing pin (330), a detonator (335), a baffle or baffle assembly (370), and a tube (380). Here again when pressure is applied to an inside portion of casing 310, that pressure may result in a shearing element (not shown) blocking port 320 rupturing. When this shearing element ruptures, a wave of pressure may move through port 320 and actuate firing pin 330. Firing pin 330 may then impact detonator 335 and this may initiate an explosion. Here firing pin 330 and detonator 335 are located within chamber 325 of the perforation apparatus. FIG. 3 also includes perforating gun chamber 340 that contains detonation cord 345 and a plurality of explosive charges 350. The perforation apparatus of FIG. 3 also includes area 360 that is coupled to area 360 where debris left behind from explosive charges 350 may be forced when explosive charges 350 explode.

Next to area 360 of the perforation apparatus is baffle 370 that may include two portions (e.g., portion 373 and portion 375). Portions 373 and 375 of baffle 370 may direct forces and debris from the explosion of charges 350 from being directed into tube 380. Filter or screen 378 may also act to prevent debris from entering tube 380. FIG. 3 includes an expanded view 305 of baffle 370. Expanded view 305 of FIG. 3 shows portions 373 and 375 of baffle 370, holes or openings 379 that may be included in baffle 370, filter or screen 378, and tube 380. In some instances, baffle 370 may be a single piece that is shaped similar to a test tube with holes on the side. In other instances, baffle 370 may be made using multiple pieces, for example, baffle portion 373 and baffle portion 375 may each be a separate piece that are included in an assembly.

Portion 373 of baffle 370 may referred to as a tip portion of baffle 370. Portion 375 of baffle may be referred to as an elongated side portion of baffle 370. Filter or screen 378 may be placed on top of baffle 370, and as such a surface of baffle 370 that abuts screen 378 may be referred to as a "top portion" of baffle 370. Furthermore, tip portion 373 of baffle 370 may be located at a "bottom" or lower portion of baffle 370.

Lower curved (down hole facing) parts of the lower baffle portion 373 of baffle 370 may directly deflect the blast force and debris based on the curved shape illustrated in FIG. 3. Upper baffle portion 375 may be shaped to block this force and debris from circling around and entering tube 380. An inside part of portion 373 of baffle 370 may be shaped as a receptacle (a hollow). Holes or openings 379 in baffle 370 may allow fluid (e.g., gasses from the wellbore) to flow (travel) into baffle 370, through filter or screen 378 and into tube 380 after a pathway between inner portions of perforation apparatus 300 and wellbore strata have been established. For example, when carbon dioxide is pumped into subterranean strata from a nearby wellbore, progression of this carbon dioxide may be monitored based on samples of a wellbore fluid being passed to sensors 390. Samples of the wellbore fluid may flow from the subterranean strata into perforation apparatus 300 and into tube 380 after explosive charges 350 have been detonated.

When the perforation apparatus of FIG. 3 is located inside a wellbore, vapor in the air (e.g., water vapor) may condensate into a liquid (e.g., liquid water) that may then flow down tube 380 and drip into the hollow internal portion of baffle 370. In such an instance, the liquid would be trapped inside of the baffle where it may once again evaporate into a vapor. The shape of baffle 370 may, thus, perform two purposes: first it may prevent liquid (e.g., water) from dripping into perforating gun chamber 340, and secondly it may prevent explosive forces and debris from directly bearing on or flowing into tube 380. Filter or screen 378 may also act to block any debris from entering tube 380. Note that tube 380 may lead to sensor 390 and sensor 390 may provide data to a computer or other device (e.g., a chromatograph) that monitors content of fluids that flow up tube 380 toward sensor 390.

In certain instances, screen 378 may have a tapered or cone-like shape as screen 378-ALT of FIG. 3 illustrates. Such a shape may direct flow of liquid dripping out of tube 380. In such an instance, the liquid may flow downward along sides of screen 378-ALT toward a lower tip 378-TIP portion of that screen and then the liquid may drip into a hollow portion of baffle 370 located below screen 378-ALT.

As such, baffle 370 may protect explosive charges 350 included within the perforation apparatus, may protect tube 380 from being exposed to explosive forces, and may prevent debris from entering tube 380 of the perforation apparatus 300 of FIG. 3. Since tube 380 is coupled to sensors 390, once fluid communication between wellbore strata next to perforation apparatus 300 is established, fluid from the wellbore strata may be transferred to sensors 390 when operations of a wellbore are monitored.

Figure 4:
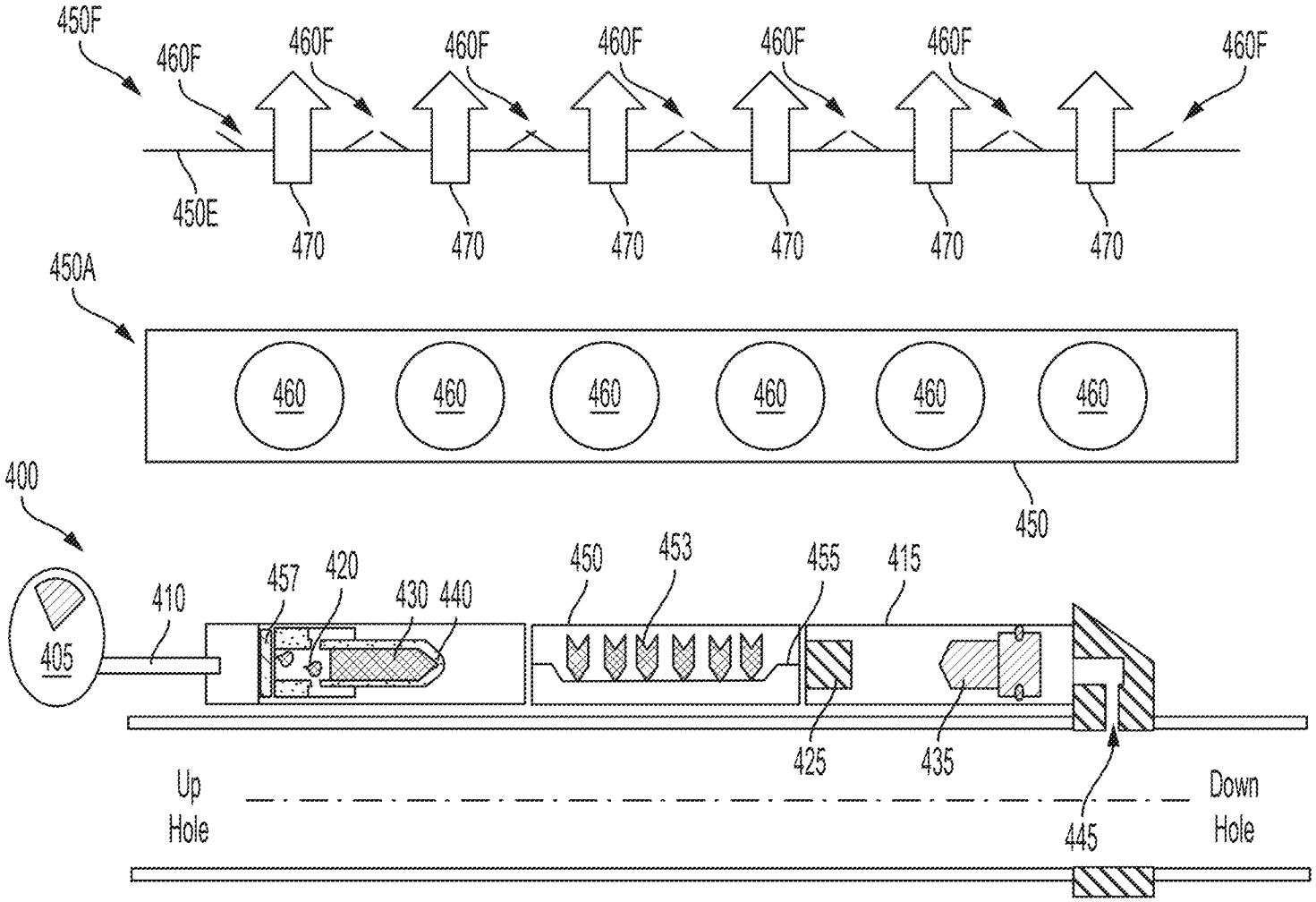
FIG. 4 illustrates how the components of FIG. 3 may be used in accordance with various aspects of the subject technology.

FIG. 4 illustrates how the components of FIG. 3 may be used in accordance with various aspects of the present technology. FIG. 4 includes image 400 that illustrates baffle 440 protecting explosive charges 453 and detonation cord 455 from being exposed to drops 420 of liquid. FIG. 4 also includes chamber 415 within which detonator 425 and firing ping 435 are located. Drops 420 may be formed from water that condensed and flowed down tube 410 and through screen 457 before dropping into the hollow space 430 of baffle 440. This shows how liquid water dripping from above may be captured (trapped) in the hollow space 430 of baffle 440. As such, baffle 440 protects explosive charges 453 and detonation cord 455 from being wetted with water. Access port 445 may allow pressure of a pressure wave to enter access port 445 and initiate operation of firing ping 435 that impacts detonator 425 to ignite detonation cord 455 and detonate explosive charges 453. In certain instances, explosive charges 453 may be shaped charges and as such, explosive charges 453 may have a shape (e.g., a conical or hemispherical shape) that focuses blast energy and potentially shrapnel in one or more desired directions.

FIG. 4 includes three different images, a first image 400, a second image 450A, and a third image 450F of parts of a perforation device. Image 400 shows a perforation apparatus attached to a casing. Image 450A shows an expanded edge view of perforating gun chamber 450 where one or more charges (e.g., shaped charges or other charges) are located. Image 450F shows an expanded side view of surface 450E of perforating gun chamber 450. When shaped charges are detonated, the internal liner elements form and generate a high velocity jet of particles that push through areas 460 of perforating gun chamber 450. Arrows 470 of image 450F represent the force bursting through areas 460 of perforating gun chamber 450, as indicated by shrapnel 460F may help blast holes in portions of casing and/or wellbore strata when an explosion within perforating gun chamber 450 occurs as illustrated in image 450F of FIG. 4.

In certain instances, perforating gun chamber 450 may include zones (e.g., at areas 460) that allow forces generated by an explosion to blast through one or more side walls of perforating gun chamber 450), for example, as indicated by arrows 470. In certain instances, features located on a side portion of perforating gun chamber 450 may help direct a jet of particles and/or shrapnel 460F. Such features may include weakened or thinned sections in a wall of perforating gun chamber 450. Weakened or thin spots or areas (e.g., areas 460) may be made using a machining process such as milling or stamping. For example, a thinned section of perforating gun chamber 450 may be located next to a shaped charge. A thinner section of material may help reduce an amount of energy required to burst through the wall of perforating gun chamber 450 such that more energy is included in a jet that escapes perforating gun chamber 450. In one or more other instances: a perforating gun chamber may not include machined areas (e.g., "slick-wall" design) or the perforating gun chamber may include a port (e.g., a port that may be blocked with a plug, frangible material, or a seal).

After explosive charges 453 are detonated, perforations made by that detonation may allow wellbore fluids to flow into and perforation gun chamber 450 and then move along tube 410 to sensors 405. As discussed in respect to sensors 390 of FIG. 3, sensors 405 may be used to monitor the content of wellbore fluids.

As discussed in respect to FIG. 3, keeping fluids like water out of the perforating gun chamber of a perforation apparatus makes operation of the perforation apparatus more reliable. Failure mechanisms associated with fluid (e.g., water) dampening or wetting detonation cord and/or explosive charges include lack of detonation of the charges, partial detonation of the chargers, or bursting of perforating gun chamber 450 in unintended directions. In an example, water located within perforating gun chamber may concentrate explosive forces in a manner that causes the chamber to blow up without focusing the explosive forces as toward wellbore strata as intended. It may be expected that when a perforation device operates as designed, forces that create perforations in subterranean strata may be directed toward that strata and away from a wellbore casing or other structure that the perforation device may be attached to.

Figure 5:
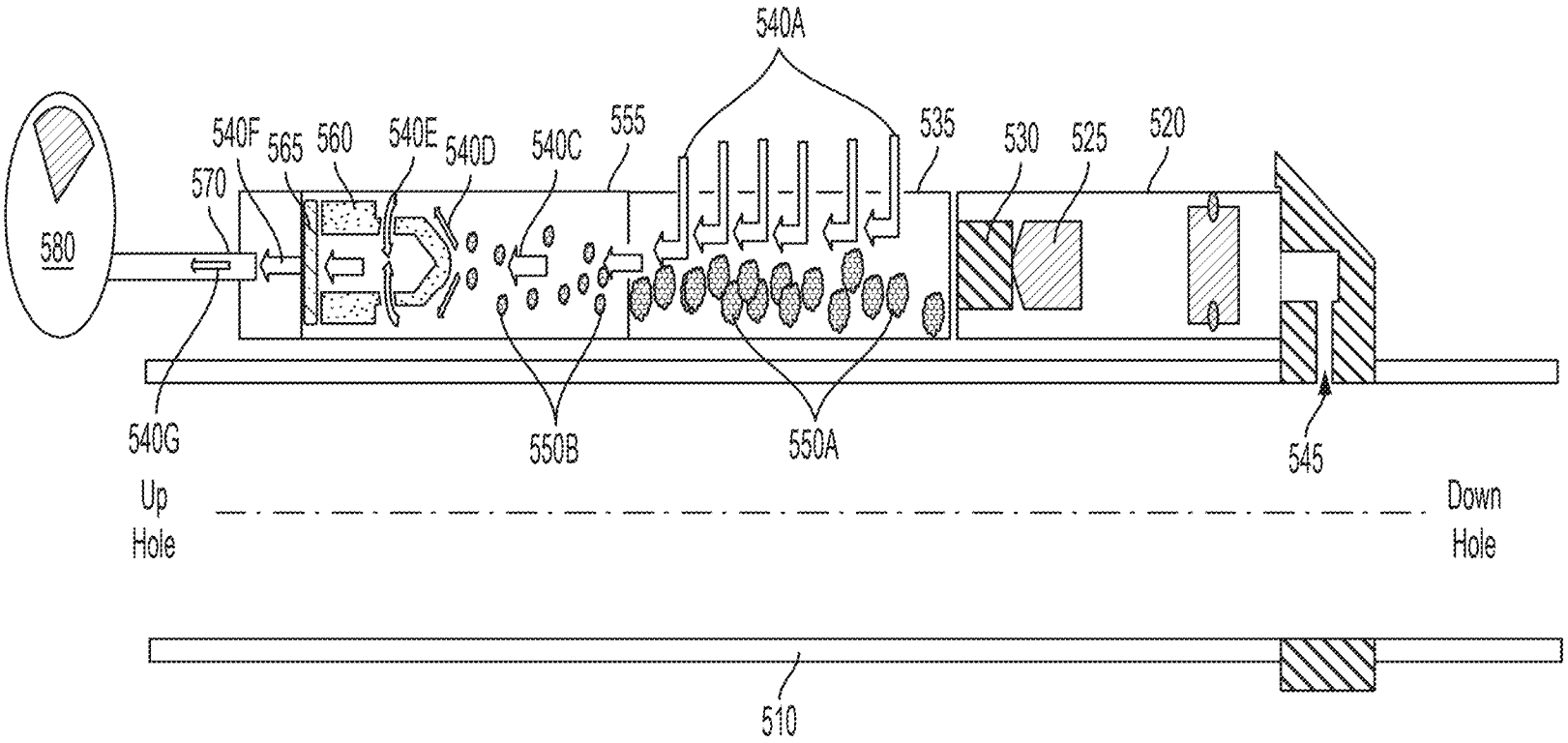
FIG. 5 illustrates operation of a perforation apparatus of the present disclosure after an explosion has been detonated, in accordance with various aspects of the subject technology.

FIG. 5 illustrates operation of a perforation apparatus of the present disclosure after an explosion has been detonated. The explosion may be detonated after firing ping 525 impacts detonator 530. Chamber 520 may be referred to as an ignition chamber that contains detonator 530 and firing pin 525. Chamber 535 may be coupled to an internal portion of casing 510 via port 545 after the explosion. The explosion may blast holes in a side portion of perforating gun chamber 535 and this may cause perforations to be formed in subterranean strata next to the perforation apparatus. This explosion may also generate particles 550A and particles 550B. After shock waves of the explosion subside, fluid (e.g., gas) may flow into the perforation apparatus though holes or openings as indicated by arrows 540A. This fluid may flow up hole into debris chamber 555 through a passageway (e.g., a hole) that separates perforating gun chamber 535 from debris chamber 555. The passageway or hole that connects perforating gun chamber 535 to debris chamber 555 may prevent (or mitigate) particles 550A from moving into debris chamber 555. Particles 550B may have been pushed into debris chamber 555 by explosive forces or movement of fluid through the hole that separates perforating gun chamber 535 from debris chamber 555. Particles 550B may be smaller than particles 550A and particles 550A and 550B may be captured in chambers 535 and 555. Fluid moving through chamber 555 may follow the path of arrows 540C, 540D, 540E, 540F, and 540G. As such, fluids like carbon dioxide sequestered in subterranean strata may be directed to flow around a pointy lower tip portion of baffle 560 as indicated by arrows 540D. This fluid may flow through holes in baffle as shown by arrows 540E, through filter or screen 565 as shown by arrow 540F, and into tube 570 as shown by arrow 540G. The fluid may flow to sensor 580 such that constituent components of the fluid or fluid densities may be identified. Here again the perforation apparatus is shown as being attached to a casing (e.g., casing 510 of FIG. 5). In instances, when a baffle is made of two parts, the "holes" in the baffle mentioned above may be spaces that separate a top part of the baffle from a bottom part of the baffle.

The relatively pointy end of baffle 560 may also deflect explosive forces away from tube 570 along the path of arrows 540D of FIG. 5. In instances when casing 510 and the perforation apparatus are cemented in place, explosive energy exiting perforating gun chamber 535 may also blast holes in cement that attaches the casing to the wellbore. Baffle 560 and potentially screen 565 may shield tube 570 from shock waves generated by an explosion, as such, baffle 560 and screen 565 may prevent tube 570 from being damaged by the explosion.

Once the flow of fluids from the subterranean strata is initiated, constituent components included in that fluid may be identified. This may allow long term monitoring of the wellbore to be performed. One application of such a monitoring system may be to monitor carbon dioxide sequestered underground.

Figure 6:
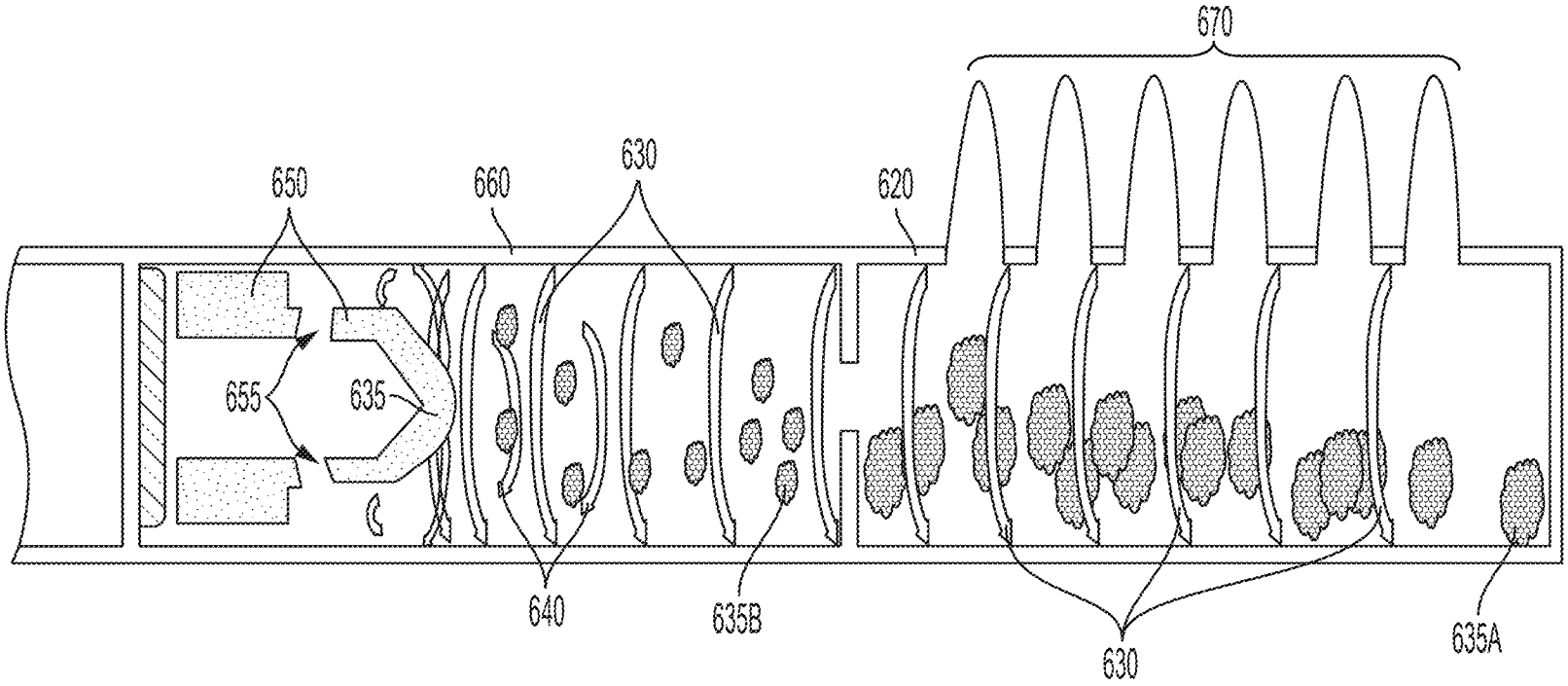
FIG. 6 illustrates shock waves of explosive force moving through a perforation apparatus of the present disclosure, in accordance with various aspects of the subject technology.

FIG. 6 illustrates shock waves of explosive force moving through a perforation apparatus of the present disclosure. FIG. 6 includes perforating gun chamber 620 and a second chamber 660 where baffle 650 of the present disclosure resides. Since an explosion occurring in perforating gun chamber 620 will tend to propel debris into the second chamber 660, this second chamber may be referred to as a debris chamber. While FIG. 6 shows two chambers (perforating gun chamber 620 and debris chamber 660) where the second chamber 660 also includes baffle 650, perforation devices of the present disclosure may include additional chambers. For example, one chamber may house a firing assembly (e.g., a firing pin and detonator), a second chamber may house explosive components, a third chamber may be a debris chamber, and a baffle consistent with the present disclosure may be included in a fourth chamber. Some of these chambers may be separated from another by a respective small passageway through which shock waves from an explosion may be controllably directed.

Like FIG. 5, FIG. 6 also shows larger particles 635A and smaller particles 635B. Shock waves 630 from an explosion may move from chamber 620 to chamber 660, where they impact an end portion 635 of baffle 650. Shock waves 640 represent reflections of shock waves 630 after shock waves 630 impact the pointy end portion 635 of baffle 650. Note that the reflected shock waves 640 are smaller than shock waves 630 as some of the energy from the explosion has been absorbed and/or redirected by the pointy end portion 635 of baffle 650. In certain instances, the end portion 635 of baffle 650 may have a rounded (e.g., conical) or pointed shape and baffle 650 may also include a hollow space that traps liquid. In certain instances, baffle 650 may be flexible such that it absorbs energy that impacts baffle 650 more efficiently.

The explosion that created shock waves 630 may also generate shock waves 670 that exit perforating gun chamber 620 toward subterranean formations next to chamber 620. When an explosion occurs shock waves 630 may move into chamber 660 from perforating gun chamber 620. As pressure builds and as shock waves 640 reflect off the end portion 635 of baffle 650, shearable elements (when used) or a wall of perforating gun chamber 620 located next to (proximal to) explosive charges may burst as shock waves 670 exit the perforation device. The bursting of the shearable elements or wall of perforating gun chamber 620 may create openings or holes in the side of perforating gun chamber 620. These opening or holes may allow shock waves 670 to blast protrusions in formations next to perforating gun chamber 620. Once these openings in the perforating gun chamber have been formed. Fluids located in the strata next to the perforating gun chamber may flow through the openings in the perforating gun chamber, through chambers 620 & 660, and through holes or openings 655 in baffle 650 to a tube located above baffle 650.

Fluids moving from formations (subterranean strata) next to a perforation apparatus may flow through the perforation apparatus and up a tube that leads to sensors or a sensing apparatus. In instances when the well where the perforation apparatus is located is dedicated to sensing carbon dioxide sequestered underground, concentrations of carbon dioxide may be monitored by the sensors or sensing apparatus. Other sensors, for example, sensors capable of measuring down hole temperatures and pressures may be used. As such, fiber optic sensing lines, electromagnetic, or other sensors may be deployed such that downhole temperatures and/or pressures may be monitored while movement or the presence of carbon dioxide is determined from collected data. Sensors of the present disclosure may be coupled to a computer that performs evaluations such that operations of one or a field of wellbores may be monitored overtime. Concentrations of carbon dioxide sequestered underground may be monitored to make sure that trapped carbon dioxide is not escaping from underground strata/formations.

Figure 7:
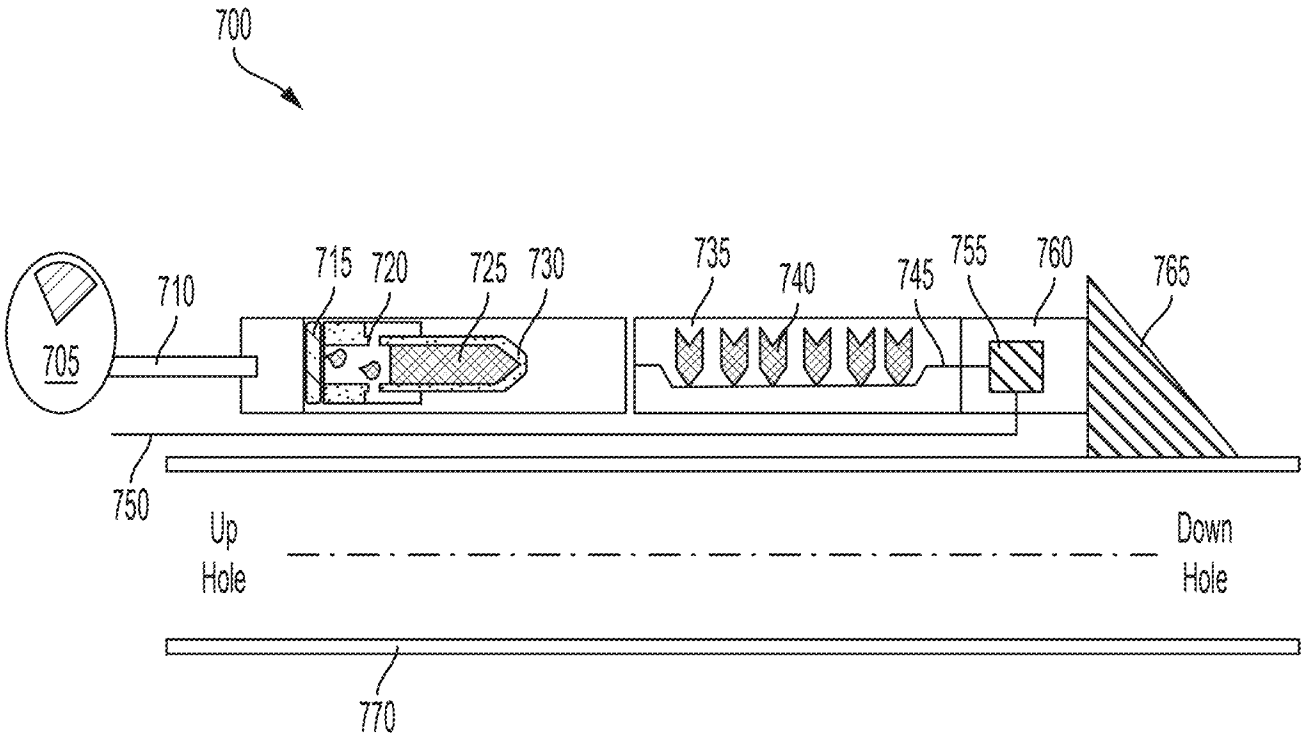
FIG. 7 illustrates a perforation apparatus where a dedicated control line may be used to trigger the detonation of explosive charges within a perforation apparatus, in accordance with various aspects of the subject technology.

FIG. 7 illustrates a perforation apparatus where a dedicated control line may be used to trigger the detonation of explosive charges within a perforation apparatus. Perforation apparatus 700 of FIG. 7 includes many of the same elements as the perforation apparatus discussed in respect to FIGS. 3-4. FIG. 7 includes sensors 705, tube 710, screen 715, baffle 730, perforating gun chamber 735, and explosive charges 740, and detonation cord 745 that may operate in ways similar to the sensors, tubes, screens, baffles, perforating gun chamber, explosive charges, and detonation cord of the perforation apparatus of FIGS. 3-4. Here, hollow 725 may receive drops of fluid 720 that may have condensed in tube 710 and flowed down tube 710 and through screen 715 as baffle 730 keeps the fluid from dampening or wetting explosive charges 740 or detonation cord 745.

Perforation apparatus 700 also includes chamber 760, mount 765, and control line 750. Mount 765 may physically attach perforation apparatus 700 to a wellbore casing 770. One or more wires may be included in control line 750 and these wires may be used to provide an electrical signal that triggers the detonation of detonator 755 and explosive charges 740. Such a signal may be provided to ignite detonation cord 745 that in turn initiates detonation of explosive charges 740. In some instances, control line 750 may be a tube used to provide a pressure wave that initiates the detonation of explosive charges 740. In such an instance, detonator 755 may be ignited based on a firing pin being released as discussed in respect to FIG. 3.

While discussions of various figures above mentions that a perforation apparatus may be attached to a wellbore casing, in various instances, perforation devices of the present disclosure may be attached to any wellbore structure, that may include yet not be limited to a tube deployed in a wellbore, wellbore liner, strata of the wellbore, or other wellbore structure.

Figure 8:
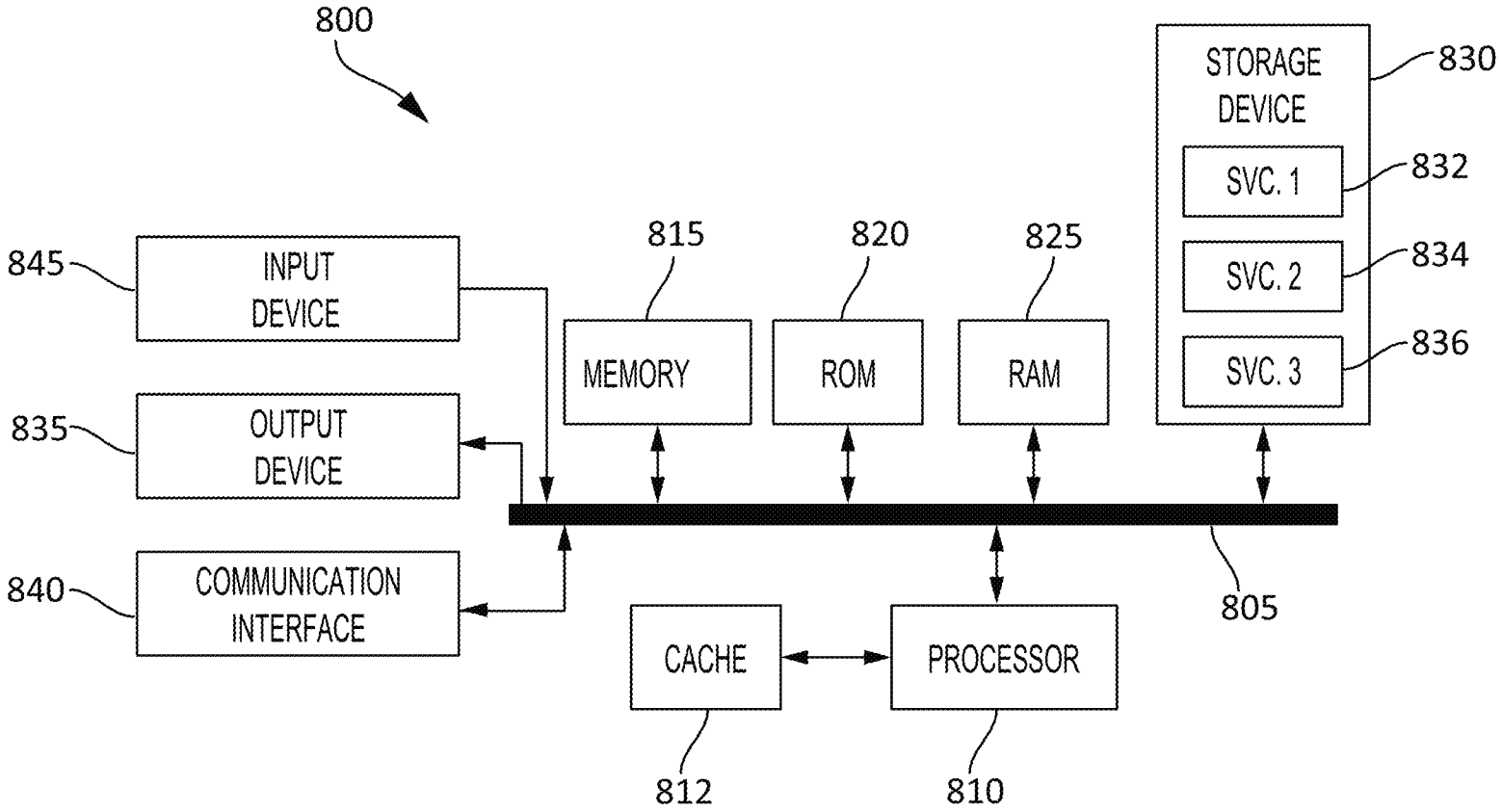
FIG. 8 illustrates an example computing device architecture which can be employed to perform various steps, methods, and techniques disclosed herein.

FIG. 8 illustrates an example computing device architecture 800 which can be employed to perform various steps, methods, and techniques disclosed herein. The various implementations will be apparent to those of ordinary skill in the art when practicing the present technology. Persons of ordinary skill in the art will also readily appreciate that other system implementations or examples are possible.

As noted above, FIG. 8 illustrates an example computing device architecture 800 of a computing device which can implement the various technologies and techniques described herein. The components of the computing device architecture 800 are shown in electrical communication with each other using a connection 805, such as a bus. The example computing device architecture 800 includes a processing unit (CPU or processor) 810 and a computing device connection 805 that couples various computing device components including the computing device memory 815, such as read only memory (ROM) 820 and random access memory (RAM) 825, to the processor 810.

The computing device architecture 800 can include a cache of high-speed memory connected directly with, in close proximity to, or integrated as part of the processor 810. The computing device architecture 800 can copy data from the memory 815 and/or the storage device 830 to the cache 812 for quick access by the processor 810. In this way, the cache can provide a performance boost that avoids processor 810 delays while waiting for data. These and other modules can control or be configured to control the processor 810 to perform various actions. Other computing device memory 815 may be available for use as well. The memory 815 can include multiple different types of memory with different performance characteristics. The processor 810 can include any general purpose processor and a hardware or software service, such as service 1 832, service 2 834, and service 3 836 stored in storage device 830, configured to control the processor 810 as well as a special-purpose processor where software instructions are incorporated into the processor design. The processor 810 may be a self-contained system, containing multiple cores or processors, a bus, memory controller, cache, etc. A multi-core processor may be symmetric or asymmetric.

To enable user interaction with the computing device architecture 800, an input device 845 can represent any number of input mechanisms, such as a microphone for speech, a touch-sensitive screen for gesture or graphical input, keyboard, mouse, motion input, speech and so forth. An output device 835 can also be one or more of a number of output mechanisms known to those of skill in the art, such as a display, projector, television, speaker device, etc. In some instances, multimodal computing devices can enable a user to provide multiple types of input to communicate with the computing device architecture 800. The communications interface 840 can generally govern and manage the user input and computing device output. There is no restriction on operating on any particular hardware arrangement and therefore the basic features here may easily be substituted for improved hardware or firmware arrangements as they are developed.

Storage device 830 is a non-volatile memory and can be a hard disk or other types of computer readable media which can store data that are accessible by a computer, such as magnetic cassettes, flash memory cards, solid state memory devices, digital versatile disks, cartridges, random access memories (RAMs 825), read only memory (ROM 820), and hybrids thereof. The storage device 830 can include services 832, 834, 836 for controlling the processor 810. Other hardware or software modules are contemplated. The storage device 830 can be connected to the computing device connection 805. In one aspect, a hardware module that performs a particular function can include the software component stored in a computer-readable medium in connection with the necessary hardware components, such as the processor 810, connection 805, output device 835, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Aspects of the disclosure include:

Aspect 1. An apparatus comprising: a tube controllably configured to transport a wellbore fluid; and a baffle that has a tip portion and an elongated side portion, wherein: the baffle has one or more openings on the elongated side portion of the baffle, and the baffle has a hollow space configured to receive a liquid from the tube based on the tube being located above the baffle. The apparatus, further comprising a perforating gun chamber that includes a wall; and an explosive charge disposed in the perforating gun chamber proximal to the wall of the perforating gun chamber, wherein: a shock wave generated by explosion of the explosive charge impacts the tip portion of the baffle and is directed away from the one or more openings on the elongated side portion of the baffle, pressure from the explosion generates a hole in the wall of the perforating gun chamber, and the wellbore fluid travels through the hole in the wall of the perforating gun chamber and into the tube via the perforating gun chamber.

Aspect 2: The apparatus of aspect 1, wherein the tip portion of the baffle has a smaller cross-sectional area than the elongated side portion of the baffle.

Aspect 3: The apparatus of aspects 1 or 2, wherein the tip portion of the baffle has a cone shape.

Aspect 4: The apparatus of any of aspects 1 through 3, further comprising: a trigger port; and a firing assembly coupled to the trigger port, wherein: operation of the firing assembly is initiated based on a trigger pressure, and the operation of the firing assembly initiates the explosion.

Aspect 5: The apparatus of and of aspects 1 through 4, further comprising: a shearable element that blocks the trigger port, wherein the operation of the firing assembly is initiated based on a/the trigger pressure being introduced to a/the trigger port.

Aspect 6: The apparatus of and of aspects 1 through 5, further comprising a debris chamber located between the perforating gun chamber and the baffle.

Aspect 7: The apparatus of and of aspects 1 through 6, further comprising a passageway disposed between the perforating gun chamber and a/the debris chamber that is configured to mitigate a first set of debris particles from moving to the debris chamber.

Aspect 8: The apparatus of and of aspects 1 through 7, further comprising a screen disposed between the tube and the baffle.

Aspect 9: The apparatus of and of aspects 8, wherein: the screen has a tip portion that has a smaller cross-sectional area than at least one other portion of the screen, and the screen is configured to direct the liquid from the tube toward tip portion of the screen based on the tip portion of the screen having the smaller cross-sectional area than at least one other portion of the screen.

Aspect 10: The apparatus of and of aspects 1 through 9, further comprising an electrical detonator that initiates the explosion of the explosive charge.

Aspect 11: A method comprising: placing a baffle into a perforation apparatus such that the baffle is next to a perforating gun chamber of the perforation apparatus, the baffle including a tip portion and an elongated side portion, wherein an internal surface of the elongated side portion of the baffle forms a hollow; and placing a tube above the elongated side portion of the baffle, wherein: the tube is configured to transport a liquid to the internal surface of the hollow to mitigate the liquid from wetting an explosive charge of the perforation apparatus, and the tube is controllably configured to transport a wellbore fluid to a sensor. This method may also include initiating detonation of the explosive charge, wherein: a shock wave generated by explosion of the explosive charge impacts the tip portion of the baffle and is directed away from the tube, pressure from the explosion generates a hole in a wall of the perforating gun chamber, and the wellbore fluid travels through the hole in the wall of the perforating gun chamber and into the tube via the perforating gun chamber.

Aspect 12: The method of aspect 11, further comprising: deploying the perforation apparatus into a wellbore; and identifying constituent components included in the wellbore fluid based on operation of a sensing apparatus.

Aspect 13: The method of aspect 11 or 12, further comprising trapping the liquid received from the tube in the hollow.

Aspect 14: The method of any of aspects 11 through 13, further comprising: emitting a pulse of hydraulic pressure to initiate an explosion in the perforating gun chamber, wherein the pulse of hydraulic pressure: passes through a trigger port of the perforation apparatus, and initiates the explosion in the perforating gun chamber.

Aspect 15: The method of any of aspects 11 through 14, further comprising collecting debris in a debris chamber of the perforation apparatus.

Aspect 16: The method of any of aspects 11 through 15, wherein a passageway is disposed between the perforating gun chamber and a/the debris chamber, and the passageway mitigates a first set of debris particles from moving to the debris chamber.

Aspect 17: The method of any of aspects 11 through 16, further comprising placing a screen between the tube and the baffle.

Aspect 18: The method of any of aspects 11 through 17, wherein the screen mitigates debris from moving into the tube.

Aspect 19: The method of any of aspects 11 through 18, further comprising an electrical detonator that initiates the explosion of the explosive charge.

Aspect 20: The method of any of aspects 11 through 19, wherein the tip portion of the baffle has a cone shape.

What is claimed is:

1. An apparatus comprising:
a tube configured to transport a wellbore fluid;
a baffle that has a tip portion and an elongated side portion, wherein:
the baffle has one or more openings on the elongated side portion of the baffle, and
the baffle has a hollow space configured to receive a liquid from the tube based on the tube being located above the baffle;
a perforating gun chamber that includes a wall; and
an explosive charge disposed in the perforating gun chamber proximal to the wall of the perforating gun chamber.

2. The apparatus of claim 1, wherein the tip portion of the baffle has a smaller cross-sectional area than the elongated side portion of the baffle.

3. The apparatus of claim 1, wherein the tip portion of the baffle has a cone shape.

4. The apparatus of claim 1, further comprising:
a trigger port; and
a firing assembly coupled to the trigger port.

5. The apparatus of claim 4, further comprising:
a shearable element that blocks the trigger port.

6. The apparatus of claim 1, further comprising:
a debris chamber located between the perforating gun chamber and the baffle.

7. The apparatus of claim 6, further comprising:
a passageway disposed between the perforating gun chamber and the debris chamber that is configured to mitigate a first set of debris particles from moving to the debris chamber.

8. The apparatus of claim 1, further comprising:
a screen disposed between the tube and the baffle.

9. The apparatus of claim 8, wherein:
the screen has a tip portion that has a smaller cross-sectional area than at least one other portion of the screen, and
the screen is configured to direct the liquid from the tube toward the tip portion of the screen based on the tip portion of the screen having a smaller cross-sectional area than at least one other portion of the screen.

10. The apparatus of claim 1 further comprising:
an electrical detonator configured to initiate the explosion of the explosive charge.

11. A method comprising:
placing a baffle into a perforation apparatus such that the baffle is next to a perforating gun chamber of the perforation apparatus, the baffle including a tip portion and an elongated side portion, wherein an internal surface of the elongated side portion of the baffle forms a hollow;
placing a tube above the elongated side portion of the baffle, wherein:
the tube is configured to transport a liquid to the internal surface of the hollow to mitigate the liquid from wetting an explosive charge of the perforation apparatus, and
the tube configured to transport a wellbore fluid to a sensor; and
initiating detonation of the explosive charge, wherein:
a shock wave generated by explosion of the explosive charge is configured to impact the tip portion of the baffle and be directed away from the tube,
pressure from the explosion is configured to generate a hole in a wall of the perforating gun chamber, and
allow the wellbore fluid to travel through the hole in the wall of the perforating gun chamber and into the tube via the perforating gun chamber.

12. The method of claim 11, further comprising:
deploying the perforation apparatus into a wellbore; and
identifying constituent components included in the wellbore fluid based on operation of a sensing apparatus.

13. The method of claim 11, further comprising:
trapping the liquid received from the tube in the hollow.

14. The method of claim 11, further comprising:
emitting a pulse of hydraulic pressure to initiate an explosion in the perforating gun chamber, wherein the pulse of hydraulic pressure:
passes through a trigger port of the perforation apparatus, and
initiates the explosion in the perforating gun chamber.

15. The method of claim 11, further comprising:
collecting debris in a debris chamber of the perforation apparatus.

16. The method of claim 15, wherein:
a passageway is disposed between the perforating gun chamber and the debris chamber, and
the passageway mitigates a first set of debris particles from moving to the debris chamber.

17. The method of claim 11, further comprising placing a screen between the tube and the baffle.

18. The method of claim 17, wherein the screen is configured to mitigate debris from moving into the tube.

19. The method of claim 11, further comprising:
an electrical detonator configured to initiate the explosion of the explosive charge.

20. The method of claim 11, wherein the tip portion of the baffle has a cone shape.

* * * * *